United States Patent [19]

Salomon

[11] 4,061,357

[45] Dec. 6, 1977

[54] SKI BINDING HAVING A RELEASABLE BOOT PLATE PROVIDED WITH A SKI BRAKE

[76] Inventor: Georges Pierre Joseph Salomon, Chemin de la Prairie prolonge, 74003 Annecy, France

[21] Appl. No.: 672,445

[22] Filed: Mar. 31, 1976

[30] Foreign Application Priority Data

Apr. 3, 1975 France ..... 75.10434

[51] Int. Cl.[2] ..... A63C 7/10

[52] U.S. Cl. ..... 280/605; 280/618

[58] Field of Search ..... 280/605, 604, 12 AB, 280/618, 617; 188/8, 5, 6, 7

[56] References Cited

U.S. PATENT DOCUMENTS

| | | | |
|---|---|---|---|
| 3,048,418 | 8/1962 | Gertsch | 280/605 |
| 3,083,028 | 3/1963 | Miller | 280/605 |
| 3,489,424 | 1/1970 | Gertsch et al. | 280/618 |
| 3,822,070 | 7/1974 | Salomon | 280/618 |
| 3,900,205 | 8/1975 | Sittmann | 280/618 |

FOREIGN PATENT DOCUMENTS

| | | | |
|---|---|---|---|
| 2,533,465 | 2/1976 | Germany | 280/605 |

*Primary Examiner*—Joseph F. Peters, Jr.
*Assistant Examiner*—Milton L. Smith
*Attorney, Agent, or Firm*—Haseltine, Lake & Waters

[57] ABSTRACT

A ski binding of the type comprising a plate engageable by a skier's boot and a releasable mechanism for securing the plate on a ski and enabling the plate to separate from the ski if the skier should fall. A ski brake is supported by the plate and comprises at least one spade pivoted on the plate. A member movable by engagement with a skier's boot controls the spade so that the spade is retracted into an inactive position above the ski sole when the boot is placed on the plate and projects downwardly into an active position below the ski sole when the boot is separated from the plate.

10 Claims, 6 Drawing Figures

SKI BINDING HAVING A RELEASABLE BOOT PLATE PROVIDED WITH A SKI BRAKE

FIELD OF THE INVENTION

The present invention relates to improvements in ski bindings.

BACKGROUND

Bindings are already known which comprise a plate normally immobilized between a front fixed or releasable abutment and a heel member on the ski. A ski boot may be fixed to the plate by appropriate means and in particular by a "step-in" device which ensures that the rear part of the boot sole is immobilized on the plate by automatic engagement. With bindings of this type, if the skier falls, the plate is released from the ski.

These bindngs generally comprise a flexible member connecting the plate to the ski, the flexible member being consititutted, for example, by a short safety strap located below the plate or by a cable housed in the plate and biased by a spring in order to urge the plate resiliently into the fitted position.

With bindings of this type, the skier has no means of retaining his ski while putting it on. If he holds the ski with his hand, he is forced to bend down and due to this loses the advantage of the "step-in" device. Furthermore, if he does not bend down to hold his ski, there is a danger that it may slide down the slope, risking injury to third parties, breakage or loss.

SUMMARY OF THE INVENTION

It is an object of the present invention to provide a ski binding remedying this drawback.

To this end, the ski binding comprises a plate engageable by a skier's boot, releasable means for securing said plate on a ski and enabling said plate to separate from said ski if the skier should fall, a ski brake supported by said plate and comprising at least one spade pivoted on said plate, and a member movable by engagement with said boot to control said spade so that said spade is retracted into an inactive position above the ski sole when said boot is placed on the plate and projects downwardly into an active position below said ski sole when said boot is separated from said plate.

The movable member may be an integral part of the plate itself. In this case, it may be constituted by a jaw for retaining the boot, by a re-fitting lever, a pedal of the "step-in" device or even a hoop for retaining the front of the boot.

The moving member may also be formed by a pedal independent of any means for retaining the boot. In this particular application, the ski brake used may be of a much lighter construction than the ski brakes normally mounted on the skis themselves.

BRIEF DESCRIPTION OF THE DRAWING

Various embodiments of the invention will be described hereafter, as non-limiting examples, with reference to the accompanying drawings in which.

DETAILED DESCRIPTION

Figure 1:
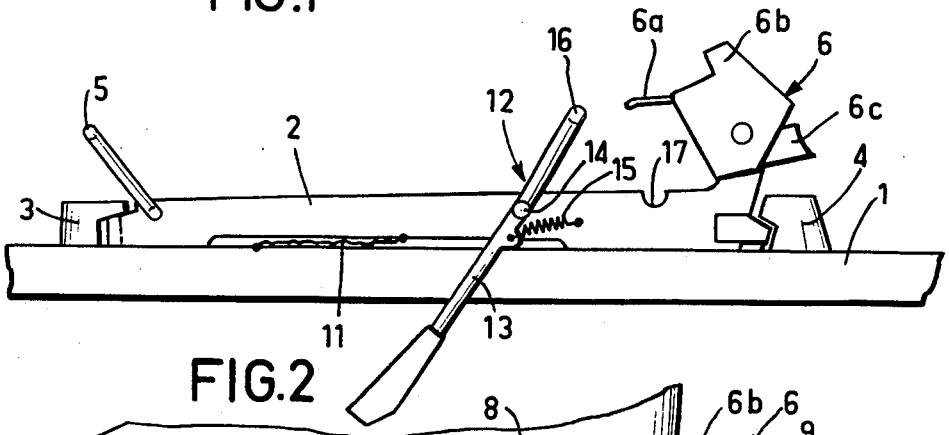
FIG. 1 is an elevational view of a ski binding comprising a plate mounted on a ski, the "step-in" device being in the released position and the ski brake in the active position.
Figure 2:
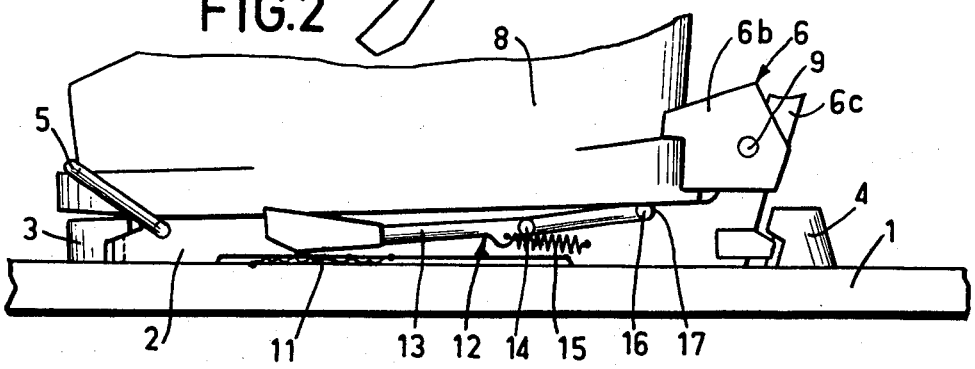
FIG. 2 is a view similar to that of FIG. 1, the ski boot being retained on the plate by the engaged "step-in" device and the ski brake being in the inactive position.

The ski binding illustrated in FIGS. 1 and 2, which is mounted on a ski 1, comprises a plate 2 immobilized between a front fixed or releasable abutment 3 and a rear heel member 4. If the front abutment 3 does not release, the heel member 4 is provided to release in the lateral direction also. In known manner, the plate 2 is provided with members facilitating engagement in the front abutment 3 and/or heel member 4. It is clear that releasable systems may also be housed in the plate and co-operate with fixed parts on the ski. These systems are not described since they are subordinate to the invention. In its upper part, the plate 2 supports a jaw 5 for retaining the front of the boot, which is constituted by a hoop pivoted about a transverse pivot on the front part of the plate 2 and a "step-in" device 6 is pivoted on the rear part of the plate 2 about a transverse pivot 9. This "step-in" device can be of any known type and comprises a pedal 6*a* on which may rest the heel of the boot to cause automatic engagement of this device, a pivoting jaw 6*b* and a re-arming lever 6*c*. FIG. 2 shows a ski boot 8 retained on the plate, the front retaining hoop 5 surrounding the front of the boot sole and the "step-in" device 6 being tilted into a horizontal position about the transverse pivot 9, to retain the heel of the boot on the plate 2.

The plate is connected to the ski 1 by a short safety strap 11 located between the plate 2 and the ski 1 and housed in a recess provided in the lower side of the plate 2.

According to the invention, the plate 2 supports a ski brake 12 comprising at least one spade 13 intended to dig into the snow, this spade 13 being pivoted laterally about a transverse pivot 14. This spade may occupy an active position illustrated in FIG. 1, in which it projects below the sole of the ski. It is normally biased into the position by a spring 15 attached firstly to the spade and secondly to the plate 2. At its upper part, the spade 13 is extended, on the other side of the pivot 14, by a pedal 16 constituted by a bent part extending above the plate 2.

Consequently, when the skier puts on his ski, the ski boot 8 bearing on the plate 2, pushes the pedal 16 towards this plate and due to this causes the pivoting of the spade 13 of the ski brake in clockwise direction. This spade thus occupies an inactive position shown in FIG. 2, in which it extends substantially horizontally along the plate 2.

To enable the spade to reach this position and in order to prevent the pedal 16 from constituting an obstacle preventing engagement of the boot in the "step-in" device, a notch 17 intended to receive the pedal 16 when the spade 13 is in the inactive position, is provided in the upper surface of the plate 2.

Due to the fact that the spade 13 normally retained in the active position by the spring 15, it will be seen that the ski 1 is not able to slide down the slope inopportunely and that the skier may put on his ski without having to bend down : in fact, retraction of the spade 13 takes place at the same time as engagement of the "step-in" device.

In the embodiment described, the moving member which controls the pivoting of the spade is constituted by an independent pedal 16.

Figure 3:
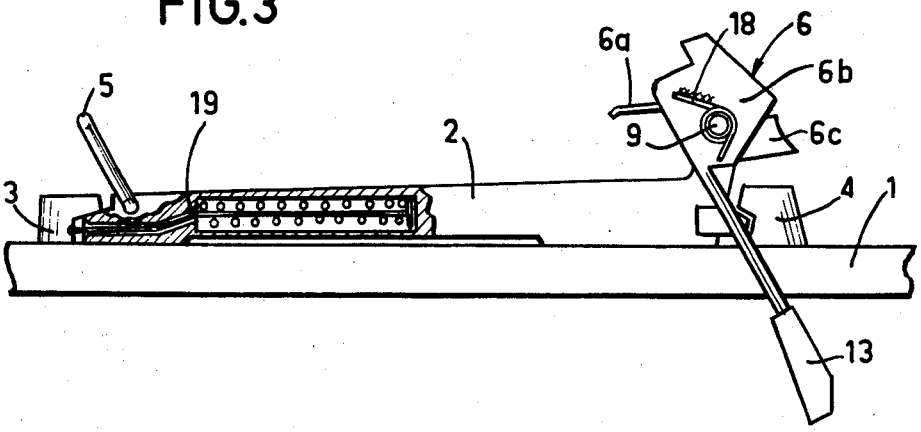
FIG. 3 is an elevational view with a partial section of a variation of the ski binding comprising a plate, the "step-in" device being released and the brake being in the active position.
Figure 4:
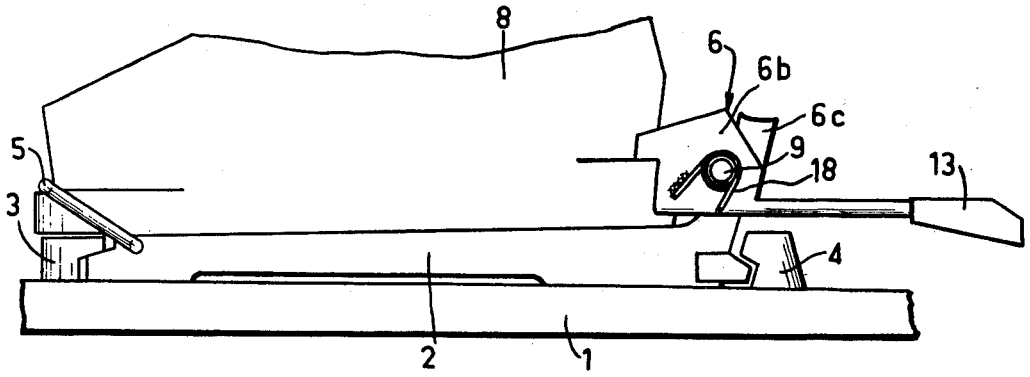
FIG. 4 is a view similar to that of FIG. 3, the "step-in" device being engaged and the brake being in the inactive position.

On the other hand, in the variation illustrated in FIGS. 3 and 4 the moving member is one of the moving members of the plate 2 which is integral with the spade 13. Under the circumstances, FIGS. 3 and 4 show that the spade 13 is integral with the jaw **6*b* of the "step-in" device 6. In this case, the inner spring 18 of the "step-in" device 6 also fulfils the function of a member for the resilient return of the spade into the active position. Preferably, the spade 13 extends towards the rear and is integral with the lower part of the jaw 6*b***.

According to other variations, the spade 13 could be integral with the arming lever **6*c* of the "step-in" device 6 or the pedal 6*a*** of the latter.

FIG. 3 shows a cable 19 ensuring the resilient return of the plate 2 to the fitted position, according to a known arrangement.

Figure 5:
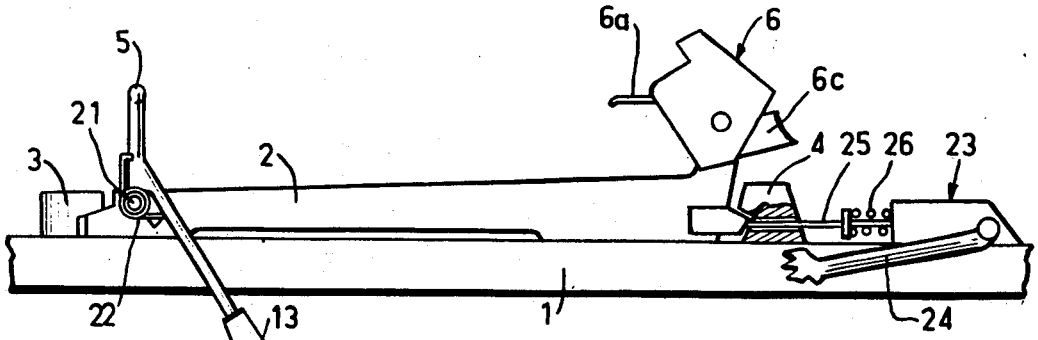
FIGS. 5 and 6 are elevational views of variations of the ski binding comprising a plate, respectively in the active and inactive positions of the brake.
Figure 6:
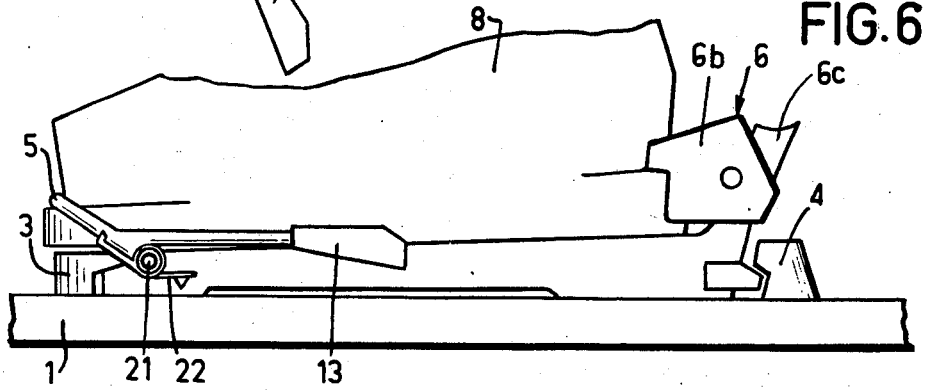

In the variation illustrated in FIGS. 5 and 6, the spade 13 is integral with the hoop 5 for retaining the front of the boot. In this case, the spade 13 pivots about the pivot pin 21 of this hoop and it is biased into the active position by a spring 22 which may be for example, a torsion spring wound on the pivot 21, one end of spring 22 being fixed to the plate 2 and the other end bearing against the hoop 5 or spade 13.

The ski 1 may also be provided with a second ski brake 23, whose spade 24 passes into the active position when a front or rear binding is released. This brake may comprise a control rod 25 for example, mounted to slide through the heel member 4 and pushed forwards by a spring 26. This rod is normally immobilized by the rear part of the plate 2, but, when the binding is released and the plate 2 leaves the heel member 4, the rod 25 is pushed forwards and causes or facilitates the passage of the spade 24 into the active position.

In all the embodiments of the invention which have been described above, the ski brake comprises a spade 13 mounted to pivot about an actual transverse pivot. However, it is clear that according to the invention it is possible to use any type of ski brake with or without an actual pivot, arranged longitudinally or obliquely, or even without a pivot (of the sliding type).

It is also possible to envisage a mechanism other than a pivoting mechanism, for controlling the brake, in particular, the mechanism may comprise a sliding member.

It wll be understood that the embodiments which have been described are given solely as examples and are in no way limiting and that several variations could be made without diverging from the framework of the present invention.

Finally, it should be noted that this brake arranged according to the invention, should simply retain the ski on a slope and not withstand considerable shocks which occur during release of the bindings during skiing. Due to this, this brake may be made more economically.

What is claimed is:

1. A ski binding comprising a plate engageable by a skier's boot, releasable means for securing said plate on a ski and enabling said plate to separate from said ski if the skier should fall, a ski brake supported by said plate and comprising at least one spade pivoted on said plate, and a member movable by engagement with said boot to control said spade so that said spade is retracted into an inactive position above the ski sole when said boot is placed on the plate and projects downwardly into an active position below said ski sole when said boot is separated from said plate.

2. A ski binding according to claim 1, wherein said movable member is independent of any means for retaining said boot on said plate.

3. A ski binding according to claim 2, wherein said spade is pivoted on said plate and is extended by a pedal extending above said plate, and a spring is provided to bias said spade into said active position.

4. A ski binding according to claim 3, wherein said plate is provided with a notch in its upper surface for receiving said pedal of said spade when said spade is in said inactive position.

5. A ski binding according to claim 1, wherein said movable member is constituted by means for retaining said boot on the plate.

6. A ski binding according to claim 5, wherein said spade is integral with a member of a "step-in" device provided at the rear of said plate.

7. A ski binding according to claim 6, wherein said member of said "step-in" device comprises a jaw thereof.

8. A ski binding according to claim 5, wherein the said spade is intergral with a hoop for retaining the front of said boot and is pivoted about a common pivot with said hoop and means for biasing said spade into said active position.

9. A ski binding according to claim 8 wherein said means for biasing said spade into active position comprises a spring attached between said spade and said plate.

10. A ski binding according to claim 8 wherein said means for biasing said spade into active position comprises a spring attached between said hoop and said plate.

* * * * *